United States Patent [19]

Zempel

[11] 4,454,828

[45] Jun. 19, 1984

[54] SYSTEM FOR BURNING BIO-MASS PELLETS

[76] Inventor: Allen M. Zempel, P.O. Box 12A, St. Ignatius, Mont. 59865

[21] Appl. No.: 460,190

[22] Filed: Jan. 24, 1983

[51] Int. Cl.[3] ..... F23G 5/04

[52] U.S. Cl. ..... 110/248; 110/224; 110/256; 110/286; 110/294; 110/101 R

[58] Field of Search ..... 110/267, 327, 286, 292–294, 110/101 R, 101 A, 101 CF, 108, 116, 118, 256

[56] References Cited

U.S. PATENT DOCUMENTS

| | | | |
|---|---|---|---|
| 715,494 | 12/1902 | Maslin et al. | 110/118 |
| 2,013,467 | 9/1935 | Ketchpel | 110/101 R |
| 2,054,805 | 9/1936 | Burton | 110/101 R |
| 2,088,678 | 8/1937 | Yamazaki et al. | 110/286 |
| 2,130,329 | 9/1938 | Sammons | 110/286 |
| 2,190,973 | 2/1940 | Bowman | 110/294 |
| 2,344,328 | 3/1944 | Schrage | 110/101 CF |
| 4,203,374 | 5/1980 | Fredrick | 110/258 |
| 4,323,037 | 4/1982 | Meyer-Kahrweg | 122/4 D |
| 4,391,205 | 7/1983 | Morey | 110/256 |

*Primary Examiner*—Henry C. Yuen

*Attorney, Agent, or Firm*—Keith S. Bergman

[57] ABSTRACT

An upwardly inclined, auger motivated stoker tube moves bio-mass pellets from a reservoir to a depending stoker nozzle through which the pellets drop onto a burning head carried in a traditional fire chamber. A relatively small orifice in the stoker nozzle aids in preventing backfire into the stoker tube. The burning head provides a convex top with peripheral rim structure to maintain bio-mass pellets in a coherent array for burning and is provided with a plurality of holes to distribute a forced air supply beneath the pellet array to aid combustion and ash removal.

5 Claims, 8 Drawing Figures

FIG. 1
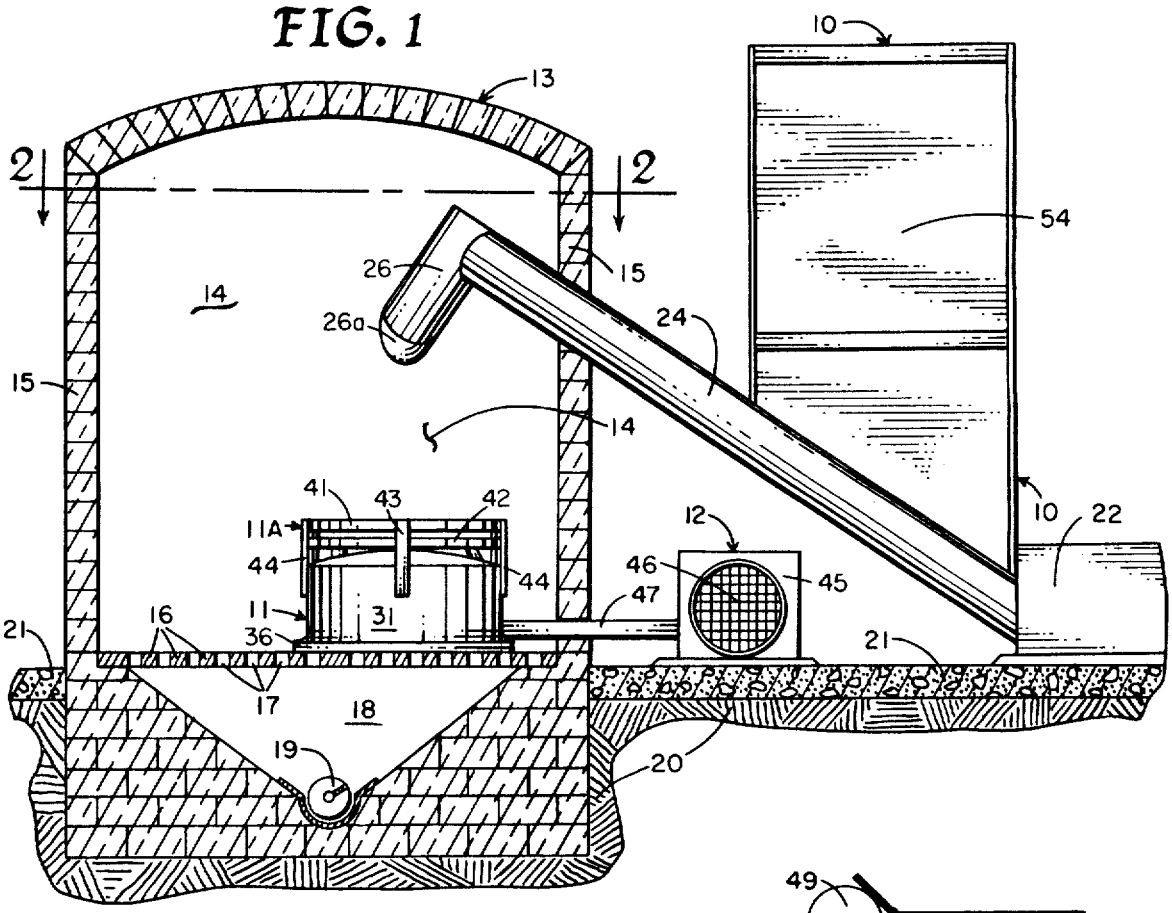
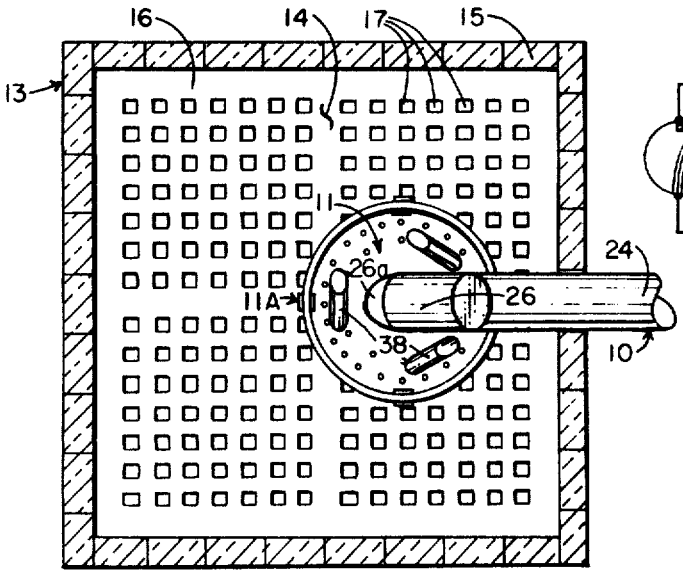
FIG. 2
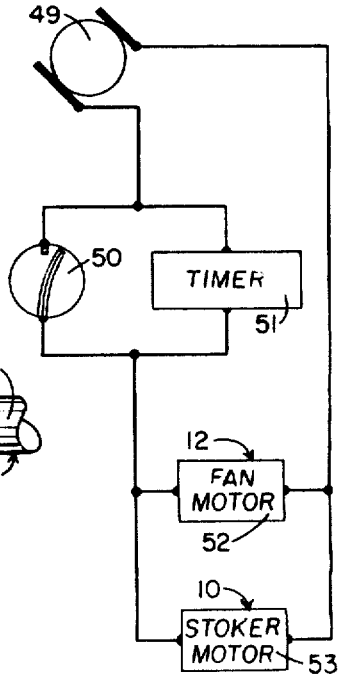
FIG. 3

SYSTEM FOR BURNING BIO-MASS PELLETS

BACKGROUND OF INVENTION

1. Related Applications

There are no applications for patent relating hereto heretofore filed in this or any foreign country.

2. Field of Invention

My invention related generally to furnaces and more particular to a stoker fed, forced air draft furnace for burning bio-mass pellets.

3. Description of the Prior Art

The so-called "bio-mass pellets" have become a popular fuel in the recent past, especially in the northern and western parts of the United States, largely because of their economy, availability and high potential heat content per unit mass. These pellets vary somewhat in configuration but generally constitute cylinders approximately nine-thirty seconds of an inch in diameter and of random lengths averaging approximately three-quarters of an inch. The pellets are formed of organic material, generally of vegetative origin and reasonable homogeneous nature, that has been finely particulated and thereafter compresses to form the configurationally stable pellets. The pellets popularly in vogue are formed substantially from wood products, quite commonly of about sixty percent tree bark and forty percent clean wood ships or sawdust, all by-products of the lumber industry. The composition of the pellets may vary widely through a broad spectrum of combustible organize materials including brush, leaves, vegetative and cereal waste and even manure from domestic animals. My furnace system is especially adapted for the burning of such bio-mass pellets.

Efficient and economical burning of these pellets present several unique problems not presented by furnaces burning traditional fossil fuels. Firstly, the pellets must be presented to the fire chamber in a way which does not allow backfiring or burning of pellets in the fuel supply system externally of the fire chamber. I prevent this backfiring by providing a stoker supply pipe that rises upwardly into the fire chamber to there communicate with a depending nozzle so arranged that fuel deposited in the nozzle passes immediately by gravity there through and into the fire chamber. This structure maintains the nozzle portion of the stoker feed free of fuel except when fuel is in motion passing downwardly therethrough to prevent any substantial combustion in the nozzle. The nozzle also has a relatively small downwardmost orifice through which fuel passes into the fire chamber to aid in preventing combustion products moving back upwardly through the nozzle to ignite fuel in the stoker feed system. Upwardly inclined stoker feed tubes have heretofore been known, especially as in sawdust burning furnaces, but the instant invention is distinguished therefrom by reason of its depending nozzle structure, which generally has not been tried with sawdust.

To be burned with any commercial efficiency, bio-mass pellets must generally be maintained in some reasonably coherent array during combustion and this combustion array must by presented with some forced air supply or draft. I provide a combustion head, substantially smaller than a combustion chamber wherein the head is contained, with an annular peripheral rim to maintain bio-mass pellets on the head. The upper surface of the head is convexly spheroidal in an upward direction so that deposited pellets tend to move toward the periphery to create a sufficiently coherent mass of pellets thereabout to support combustion, especially during times of low firing activity. A plurality of spaced air holes are defined in the combustion head to pass forced air beneath the combusting array of pellets immediately thereabove. This forced air draft tends to make combustion more efficient and serves to remove ash from the combustion head.

The upper surface of the combustion head carries plural angularly disposed vartex pipes communicating from the forced air supply to create a nortical action above the combustion head. This vortical type of gas flow enhances combustion above the fuel mass and in the fire chamber by supplying oxygen to support the combustion and providing a longer course of travel for the reacting gaseous products in the fire chamber. The forced draft system of my invention may be used with and increases efficiency in either up draft or down draft combustion chambers.

Heretofore various forced draft systems have been known in furnaces, but they have not generally applied the forced draft beneath the combusting mass of fuel and provided a vortical type air flow immediately above the combusting fuel mass to further aid and make more efficient the combustion of partially combusted gasified products of the initial sold fuel combustion.

My invention resides not in any one of these features per se, but rather in the particular combination of all of them herein disclosed and claimed and it is distinguished from the prior art in this particular combination of all of its structures for the functions specified.

SUMMARY OF INVENTION

My invention in general provides a stoker fed, forced draft combustion system for bio-mass fuel pellets.

An auger activated stoker channel receives bio-mass pellets from a hopper-type reservoir and moves the pellets on demand in an upwardly inclined direction into medial portion of a firing chamber where the pellets are deposited in a depending stoker nozzle. The stoker nozzle is positioned to allow gravity activated passage of the pellets therethrough to exit from a relatively small, lower orifice at a spaced distance above a combustion head carried in the lower medial portion of the fire chamber. The combustion head comprises a peripherally defined structure enclosing an air chamber and having an upwardly convex top with an annular rim about the periphery thereof. A plurality of spaced holes are defined in the neupheral zone of the convex top to allow passage of air from the air chamber therethrough. A plurality of angularly disposed vortex pipes, extending a spaced distance above the convex top, are arrayed to create a vortical flow of air above the burning head. A forced air system positioned externally of the fire chamber communicates to the air chamber defined by the firing head to provide pressurized air therein. Preferably a fire chamber used with my invention has a grate type bottom to allow the removal of ash therethrough.

A control system provides for periodic activation of my system without reference to prior burning history to continuously maintain a fire on the firing head. A thermostat provides for system activation when burning activity is required.

In creating such a device it is:

A principal object of my invention to create a stoker fed burner system for a furnace, having a forced air supply to efficiently burn bio-mass fuel pellets.

A further object of my invention to provide such a system with an upwardly inclined, auger activated fuel supply pipe communicating to the fire chamber to aid in preventing backfire.

A further object of my invention to provide such a fuel supply pipe that terminates within a fire chamber with a depending nozzle having relatively small lowermost orifice, again to aid in preventing backfiring therethrough into the stoker system.

A further object of my invention to provide such a system that has a combustion head with an upwardly convex surface to receive fuel from the stoker nozzle and cause that fuel to accumulate around the periphery of the firing head to there maintain a coherent mass of fuel to support and maintain combustion.

A further object of my invention to provide such a combustion head that has an annular structure extending upwardly from its periphery to maintain fuel on the firing head and about its periphery.

A further object of my invention to provide such a combustion head that defines a plurality of spacedly arrayed holes in a peripheral zone of the upper convex surface to allow pressurized air to be presented from a chamber defined therebeneath to fuel resting thereon.

A further object of my invention to provide such a combustion head that has a plurality of angularly arrayed vortex pipes extending thereabove and communicating to the chamber beneath the firing head to receive pressurized air therefrom to create a vortical flow at a spaced distance thereabove to further aid combustion of gaseous combustion products of the bio-mass fuel.

A still further object of my invention to provide such a device that is of new and novel design, of rugged durable nature, of simple and economic manufacture, and one otherwise well suited to the uses and purposes for which it is intended.

Other and further objects of my invention will appear from the following specification and accompanying drawings which form a part hereof. In carrying out the objects of my invention, however, it is to be understood that its essential features are susceptible of change in design and structural arrangement with only one practical and preferred embodiment being illustrated in the accompanying drawings as is required.

BRIEF DESCRIPTION OF DRAWINGS

In the accompanying drawings which form a part hereof and wherein like numbers of reference refer to similar parts throughout:

FIG. 1 is an orthographic side view of my invention, in a partially cut-away fire chamber, to show its various parts, their configuration and relationship.

FIG. 2 is an orthographic top view of the device of FIG. 1, taken on the line 2—2 thereon in the direction indicated by the arrows.

FIG. 3 is a diagrammatical representation, in normal symbology, of the electric circuitry of my invention.

DESCRIPTION OF THE PREFERRED EMBODIMENT

Figure 4:
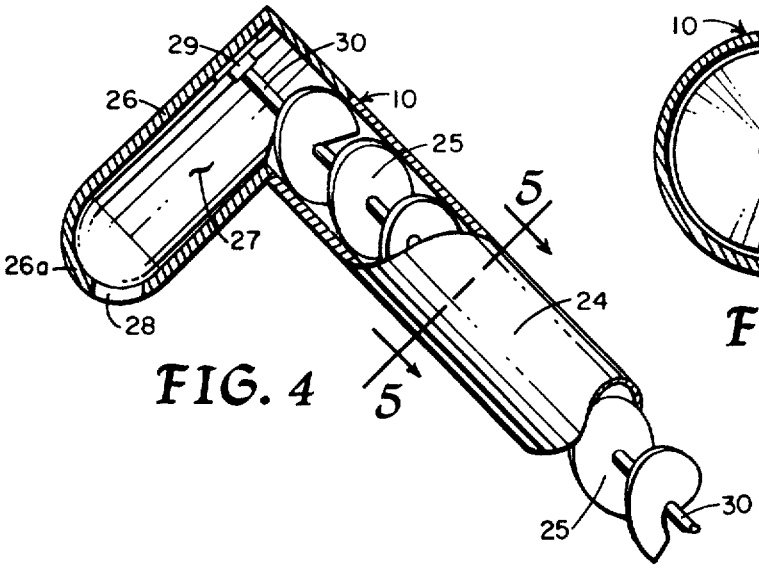
FIG. 4 is a partial, partially cut-away view of the stoker fuel supply system showing particularly the construction of the depending nozzle and its relationship to the fuel supply pipe.
Figure 5:
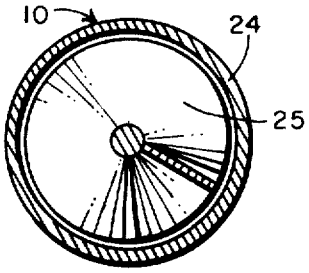
FIG. 5 is a somewhat enlarged, orthographic, cross-sectional view of the stoker fuel supply pipe of FIG. 4, taken on the line 5—5 thereon in the direction indicated by the arrows.
Figure 7:
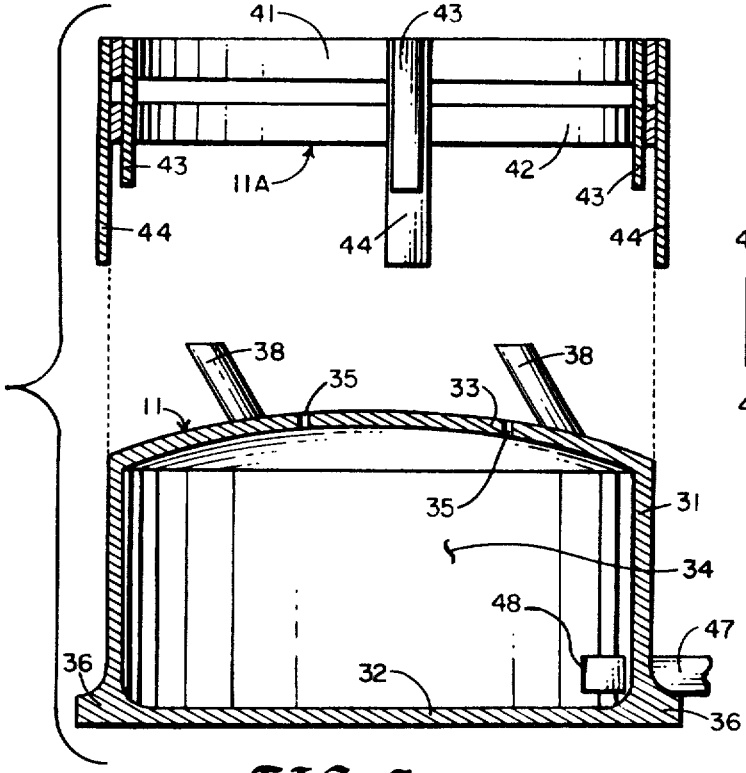
FIG. 7 is a somewhat enlarged, expanded vertical cross-sectional view of the burning head of FIG. 6, taken on the line 7—7 thereon in the direction indicated by the arrows.

My invention comprises generally stoker 10 positioned to drop bio-mass pellets onto combustion head 11 supplied with air by blower 12 and carried in furnace 13.

Furnace 13 includes fire chamber 14 defined by peripheral insulating walls 15, commonly formed of fire brick or some similar heat resistive insulating material. The floor of the fire chamber is defined by grate 16 having ash orifices 17. Ash pit 18 is defined below grate 16 to receive ash therethrough and present it to auger type conveyor 19 for removal. The furnace is generally supported in or on earth 20 and has about it concrete apron 21 which also is supported upon the underlying earth. This essential furnace structure is well known in the prior art and constitutes no part of my invention per se, though it must be used in conjunction with my invention for my invention to be useful.

Stoker 10 provides housing 22 carrying stoker motor 23 mechanically communicating with auger 25 carried in stoker feed pipe 24 to move bio-mass pellets through the feed pipe. Housing 22 is so positioned externally of fire chamber 14 that feed tube 24 angles upwardly at an angle of approximately thirty degrees from horizontal to and in the fire chamber. Auger 25 is only slightly smaller than the inner diameter of the feed tube 24 so as to have free motion relative thereto but yet aid in preventing backfiring through the feed tube by stopping free air flow through the pipe. Hopper 54 is positioned to feed contained bio-mass pellets to the feed pipe in its lower portion, preferably by gravity activated motion, as illustrated.

Feed tube 24 extends into the upper portion of fire chamber 14 through peripheral insulating walls 15. Nozzle 26 is structurally carried by the end of feed tube 24 within the fire chamber, as seen especially in FIG. 4. The nozzle comprises a pipe-like structure defining internal chamber 24 with diametrically smaller orifice 24 defined in the lowermost, nipple-like portion **26*a* of the element. The nozzle extends substantially perpendicularly from the feed tube in a steeply depending fashion to position orifice 28 at a spaced distance vertically above the medial portion of the combustion head. With this type of nozzle structure, bearing 29 may be structurally carried on the inner surface of the nozzle facing the auger to support axle 30** of that auger, to provide a mechanical structure of substantial integrity.

Both feed tube 24 and nozzle 26 are formed from thermally durable material, preferably iron or steel pipe of commerce. With such metal pipe the structural joinder of elements is preferably accomplished by welding the adjacent surfaces of each element together. The configuration of orifice 28 is preferably circular and the size of the orifice is substantially less than the diameter of nozzle pipe 26, preferably about one-third of that diameter.

Figure 8:
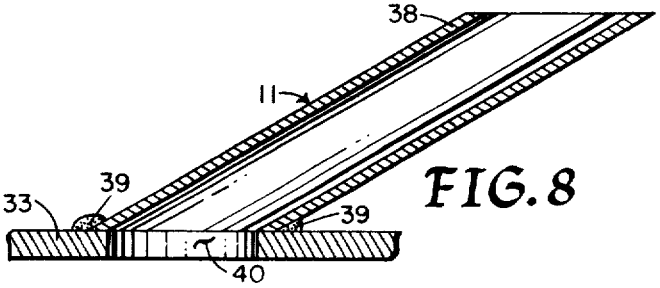
FIG. 8 is an enlarged, cross-sectional view through one of the vortex pipes of the combustion head of FIG. 6, taken on the line 8—8 thereon in the direction indicated by the arrows.

Combustion head 11, as shown especially in FIG. 8, is a cylindrical box defined by vertical side wall 31, bottom 32 and convex top 33. These relatively thin peripheral elements define an internal air chamber or plenum 34. Top 33 is somewhat convex in an upward direction and defines a plurality of spacedly arrayed draft holes 35 arrayed in an annular zone inwardly adjacent the periphery. The lower, outer portion of the combustion head may be provided with somewhat enlarged rim 36 to aid fastening and positional maintenance of the head on grate 16 or the floor of a furnace 13. Such fastening may be accomplished by ordinary fastening devices such as bolts, mortices and the like or by motar (not shown).

The combustion head is made from some rigid, durable material that can survive the thermal environs commonly associated with a furnace, preferably cast iron, though rolled mild steel and other metals will serve the purpose if not so well. The dimensioning and configuration of the combustion head is not too critical to my invention, except that the size of the top should be appropriate to maintain sufficient fuel about the periphery to maintain a fire and the curvature of the top should be such as to cause fuel falling on it to move by gravity activation toward the periphery of the head before it comes to rest. In most normal sized heating furnaces of the few hundred thousand BTU category the diameter of the cylindrical body of the combustion head will be approximately eleven to eighteen inches and the curvature of the top will be generally spherical with a radius of about three times the diameter of the cylindrical body. The size, number and array of draft holes 35 will depend upon other parameters of the burning system, particularly on the size of the combustion head, the volume of air flow presented to the forced air plenum and the amount of air flow required for efficient burning of particular bio-mass pellets. Normally the total area of the holes should approximate one-tenth of the area of the combustion head and the holes should reasonably symmetrically distributed in an areal array similar to the normal fuel distribution.

Figure 6:
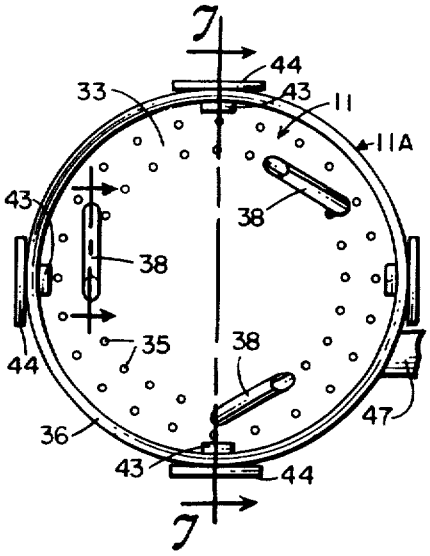
FIG. 6 is an orthographic top view of the combustion head of my invention, somewhat enlarged, from the illustration of FIG. 1.

Top 33 of the combustion head is provided with plural vortex tubes 38, in the insance illustrated three in number though more may be necessary in larger heads. The vortex tubes are formed with planar, approximately horizontal, upper and lower surfaces; are structurally joined to the top by welds 39; and communicate to the plenum of the combustion head by vortex tube holes 40 defined therein. The vortex tubes are positioned, as illustrated in FIG. 6, with an upward angle of approximately thirty degrees in a vertical plane and substantially tangential orientation in a horizontal plane. With this structure and positioning, pressurized air passing through the tubes will tend to create a vortical action at a spaced distance above the burning head.

Fuel retaining ring structure 11A extends upwardly from support about the periphery of the combustion head to aid in maintaining particulate fuel on the periphery burning head. The retaining ring structure provides similar annular retaining rings 41, 42 with external diameter substantially the same as that of side walls 31 of the combustion head. The retaining rings are maintained in vertically spaced orientation by plural structurally communicating outer spacer legs 44 an inner support legs 43, in the instance shown each four in number. The length of the depending inner supporting legs is such as to support the lowermost annular ring 42 at a spaced distance vertically above the periphery of top 33 of the combustion head and the length of the outer spacer legs 44 is sufficiently greater to allow their extension downwardly over the upper part of the side walls 31 of the combustion head to maintain the retaining ring structure in appropriate position thereover. To maintain proper and efficient burning of fuel on my combustion head, it is necessary that there be spaces between the annular rings and between the lower ring and the combustion head, but the sizing is not particularly critical so long as it is not so great as to allow particulate fuel to move off the head. In the instance illustrated, with an average size combustion head of some eleven inches in diameter, the annular rings preferably are about three-quarters of an inch in vertical dimension and are spaced approximately one-quarter inch from each other and from the combustion head. The retaining ring structure, again is preferably formed of metal such as mild steel or cast iron and its parts are interconnected by welding or similar means of structural joinder.

Blower system 12 is of the ordinary variety known in the furnace arts for supplying low pressure air from the ambient atmosphere to a combustion chamber to aid combustion. It provides fan unit 45 positioned externally of the fire chamber to receive air through orifice 46 and deliver it through channel 47 under relatively low pressure of a few pounds per square inch. Channel 47 communicates through the fire chamber wall 15 and to air input orifice 48 defined in the side wall of the combustion head to deliver pressurized air into plenum 34. The peripheral structure defining channel 47, in its inner end at least, must be such as to withstand the enirons of the fire chamber through which it extends and its sizing and configuration should be appropriate to allow passage of sufficient quantities of air at low pressures to keep the plenum supplied therewith and maintain pressure therein.

The electric circuitry operating and controlling my burning system is shown in diagrammatical fashion in FIG. 3 where it is seen to provide power source 49 communicating in series with thermostatic switch 50 and timer switch 51, both of which are parallel with each other, and in series with fan motor 52 and stoker motor 53. This essential control and power circuitry is well known and common in the operation of many furnace systems. It causes the stoker and fan to operate simultaneously and provides for their operation when power is called for either by the timer switch or the thermostatic switch so that the system will provide heat when required by falling temperatures in the environ to be heated and will also operate periodically without reference to past burning history to continuously maintain combustion and prevent backfire and explosions.

Having thusly described the structure of my invention, its operation may be understood.

In a furnace system 13 such as that described, my combustion head is supported in fire chamber 14 on the floor of that chamber, which may comprise either grate 16 as illustrated or some other supportative elements such as fire brick. The combustion head may be positionally maintained in the fire box by reason of friction caused by its own weight but if desired it may be mechanically fastened to the fire chamber floor or grate. Normally the combustion head will be established in a non-symmetrical position somewhat nearer peripheral wall 15 through which stoker feed tube 24 enters the fire chamber, though such positioning obviously is not necessary. After combustion head positioning, forced air channel 47 is established through the fire chamber wall and side walls 31 of the combustion head. Retaining ring structure 11A is then positioned to extend upwardly from the combustion head.

Stoker 10 is established with its housing 22 at a spaced distance from peripheral wall 15 of fire chamber 14. This positioning is such that feed tube 24 extends upwardly at an angle of about thirty degrees with the horizontal to enter wall 15 of the fire chamber in its upper portion as illustrated. The feed tube is so positioned that orifice 28 of nozzle 26 is vertically above the medial portion of top 33 of combustion head 11 so that material dropping by gravity through the nozzle orifice will drop onto the combustion head. The spaced distance between the upper surface of the combustion head and the orifice of the nozzle is not critical but generally it should be somewhat greater than the normal flame height of the fuel being burned, preferably at least six inches for ordinary bio-mass pellets.

Timing switch 51 of my control circuitry is set to operate about two minutes every thirty minutes to maintain sufficient fuel and pressurized air to assure a continuous burning and to aid in preventing backfiring through the stoker feed. Obviously these times are not essential and vary with fuels and particular installations so exact limits of these parameters have to be determined with each particular type of fuel and each installation. My burning system will operate by reason of the thermostatic switch whenever heat is called for without regard to its periodic operation by reason of the time switch.

In my system's operation the bio-mass fuel will pass from the storage bin to auger feed tube 24 where it will substantially fill that tube and be moved by means of rotary auger motion to nozzle 26. When the fuel passes into nozzle 26 it will move by gravity downwardly therethrough to exit from orifice 28 therein. After exiting from the nozzle the fuel will drop vertically onto top 33 of combustion head 11, where because of the convex nature of the top, the fuel particales will tend to move toward the periphery of the top. It is prevented from moving laterally off the top of the combustion head by retaining structure 11A so that the fuel will tend to accumulate about the periphery of the top where generally most burning occurs.

Pressurized air will be supplied to the burning bio-nass pellets through holes 36 in top 33. Some additional ıir from the fire chamber will be drawn through the ıpaces between annular rings 41, 42 and the space be-:ween these rings and the combustion head by reason of :he draft created by the burning fuel and also by some :nturi action created by pressurized air passing through he top of the combustion head. At the same time sub-:tantial quantities of pressurized air will be passing hrough vortex tubes 38 and this air will tend to create ı cyclonical action that tends to establish a vortex at a paced distance above the combustion head to further :id draft for the burning fuel and to tend to cause more :omplete oxidation of the incompletely oxidized com-ıustion products existing above the burning mass of uel. In general this combustion reaction is quite effi-ient as compared to the combustion reaction of most ɔssil type fuels and it is much more efficient than that vhich exists in the burning of bio-mass fuel on an ordi-ary grate type support without forced draft.

In general the various parameters of my burning system have to be regulated for particular installations and particular fuels by methods and from principals well known in the thermal arts. As the BTU content of the fuel lessens per unit volume the speed of the stoker will have to be increased proportionately and generally the amount of forced air draft will also have to be increased somewhat. In general, for bio-mass pellets formed from approximately forty percent wood shavings and sixty percent tree bark to a diameter to nine-thirty seconds of an inch and an average random length of three-quarters of an inch with heat content of eighty-six hundred to ten thousand BTUs per pound (averaging about nine thousand BTUs per pound), a system substantially as illustrated and described is effective with a combustion head approximately eleven inches in diameter, plural holes having a total area of about one-tenth that of the head, pressurized air supply of about six to eight pounds per square inch and stoker action delivering about nine to sixteen pounds of pellets per hour when the thermostat calls for heat.

In general such operation in the present day economy with bio-mass pellets costing approximately sixty dollars per ton and fuel oil costing approximately one dollar and thirty cents ($1.30) per gallon, the bio-mass system will save approximately one-half of the fuel cost over an ordinary oil system operating under the same conditions.

It is to be particularly noted that in the past, stoker systems supplying particulate bio-mass type fuel, and especially those supplying sawdust, have had a tendency to allow backfiring through a stoker supply tube. The instant invention is remarkably free from this problem by reason of a combination of factors. Firstly, the stoker tube itself is angled upwardly which tends to alleviate backfiring as the fuel will not burn in a downward direction nearly so readily as it will burn in a horizontal or upward direction. Secondly, the bio-mass fuel itself is relatively friable and the fines created in it will tend to cause a solid mass which prevents draft and makes combustion in the fuel mass much more difficult. Thirdly, the positioning of the nozzle does not allow the accumulation of fuel therein and the restriction of its orifice tends to prevent a flame front or combustion products that will cause fuel ignition from entering the stoker tube through the nozzle. Fourthly, the periodic operation of the stoker tends to remove any fuel that might ignite or smolder to any substantial degree in the furnace end of the stoker tube.

It is further to be noted that the forced draft aspects of my burning head will tend to aid ash removal. In general, bio-mass fuel burns with a low ash ordinarily in the range of about three percent of original fuel mass. This ash, because of the nature of the bio-mass material and of its burning, tends to be of a small, unagglomerated variety having relatively low density so that it moves readily in an air flow, so much so in fact as to be referred to as fly ash. The air exiting through the top of my burning head will tend to cause this ash to move from the burning head and it in general will come to rest on the lower floor of the combustion chamber and if that floor be a grate, as illustrated, it will tend to pass therethrough into an ash chamber therebelow. The ready removal of ash from the combusting fuel tends to make the combustion more efficient.

It is further to be noted that in general the completeness of combustion of fuel in my burning system is substantially greater than is the combustion of particulate fossil fuel in other existing combusting systems. The exact degree of combustion is dependent upon many parameters of the individual fuel and individual combustion system but in general with any bio-mass fuel and any installation the combustion is sufficiently complete that there is no visible smoke of any sort.

My system might be usable with free standing fossil fuel burning stoves but in general it finds its principal use with furnace type installations and because of present day economics oftentimes more with commercial type installations than with residential installations.

The foregoing description of my invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described my invention, what I desire to protect by Letters Patent, and

What I claim is:

1. Apparatus for burning bio-mass pellets in the fire chamber of comprising, in combination:

A stoker, with fuel storage hopper and fuel moving mechanism spacedly adjacent the furnace, having an upwardly inclined fuel feed tube extending from the fuel storage hopper into the upper part of the furnace fire chamber to there support a downwardly angled nozzle having a smaller lowermost orifice and depending to a position at a spaced distance vertically above a combustion head, and the afore said combustion head carried in the lower portion of the fuel chamber peripherally defining an air chamber and having an upwardly convext top with a plurality of a spacedly arrayed holes defined therein and a retaining ring structure extending upwardly from the periphery of the top to aid in maintaining particulate fuel on the top;

means of supplying pressurized air to the air chamber defined within the combustion head; and independent control means for activating the stoker system responsive to predetermined temperature and the pressurized air system responsive to predetermined time intervals.

2. The invention of claim 1 further characterized by the stoker nozzle comprising a steeply downwardly sloping pipe to pass particulate fuel therethrough by gravity action with a lowermost hemispheric end defining an orifice, having a diameter relatively smaller than the diameter of the sloping pipe, through which particulate fuel may pass by gravity action.

3. The invention of claim 1 further characterized by the retaining ring structure comprising interconnected parallel spaced annular rings with the lowermost ring at a spaced distance above the periphery of the combustion head.

4. The invention of claim 1 further characterized by plural pipes carried in spaced array by the top of the combustion head to communicate with the air chamber defined thereby and extend in angled array a spaced distance above the combustion head top to aid in creating a vortical type air flow thereabove.

5. In a furnace for burning bio-mass pellets, having a fire chamber and a stoker feeding system, the combination comprising:

a rigid combustion head carried in the firing chamber and having peripheral walls defining a closed air chamber with a planar bottom and an upwardly convex top;

a plurality of spaced arrayed holes defined in the top in an annular zone inwardly adjacent the periphery of the top;

a plurality of spaced, angularly arrayed vortex pipes structurally carried by the top, communicating with the air chamber therebeneath and extending a spaced distance thereabove to aid in creating a vortive air flow at a spaced distance above the top; and a retaining ring structure, having means to allow air flow therethrough, extending upwardly from the periphery of the top to aid in maintaining fuel thereon and preventing it from passing off the periphery thereof; and a fuel feed pipe communicating to the upper part of the fire chamber above the combustion head, said fuel feed pipe having a pipe-like nozzle depending from structural communication at an angle with the fuel feed pipe to receive fuel pellets from the fuel feed pipe and pass them downwardly through the nozzle by reason of gravity forces acting thereon, said nozzle having, a lowermost end defining an orifice substantially smaller in area than a cross-section of the pipe-like nozzle, said orifice positioned to allow exit of particulate fuel therefrom and onto the combustion head by gravity action.

* * * * *